US007959097B2

(12) United States Patent
De Boef

(10) Patent No.: US 7,959,097 B2
(45) Date of Patent: Jun. 14, 2011

(54) GRINDING DRUM WITH A CUTTER ARRANGEMENT FOR A DIRECTION OF ROTATION

(75) Inventor: Duane R. De Boef, Sherrard, IL (US)

(73) Assignee: Vermeer Manufacturing Company, Pella, IA (US)

( * ) Notice: Subject to any disclaimer, the term of this patent is extended or adjusted under 35 U.S.C. 154(b) by 72 days.

(21) Appl. No.: 11/969,773

(22) Filed: Jan. 4, 2008

(65) Prior Publication Data

US 2008/0277509 A1 Nov. 13, 2008

Related U.S. Application Data

(60) Provisional application No. 60/878,934, filed on Jan. 5, 2007.

(51) Int. Cl.
*B02C 13/28* (2006.01)

(52) U.S. Cl. ..... 241/27; 241/101.761; 241/186.4

(58) Field of Classification Search ..... 241/26, 241/30, 101.761, 186.4, 605, 189.1, 260.1, 241/27

See application file for complete search history.

(56) References Cited

U.S. PATENT DOCUMENTS

| | | | | |
|---|---|---|---|---|
| 223,689 | A * | 1/1880 | Adams | 241/260.1 |
| 4,087,051 | A * | 5/1978 | Moeller | 241/27 |
| 5,108,040 | A * | 4/1992 | Koenig | 241/260.1 |
| 5,377,919 | A | 1/1995 | Rogers et al. | |
| 5,419,502 | A | 5/1995 | Morey | |
| 5,507,441 | A | 4/1996 | De Boef et al. | |
| 5,601,239 | A * | 2/1997 | Smith et al. | 241/29 |
| 5,950,942 | A | 9/1999 | Brand et al. | |
| 6,422,495 | B1 | 7/2002 | De Boef et al. | |
| 6,840,471 | B2 | 1/2005 | Roozeboom et al. | |
| 6,880,774 | B2 * | 4/2005 | Bardos et al. | 241/189.1 |
| 7,204,442 | B2 | 4/2007 | Roozeboom et al. | |
| 2002/0125353 | A1 | 9/2002 | Bardos et al. | |

* cited by examiner

*Primary Examiner* — Mark Rosenbaum
(74) *Attorney, Agent, or Firm* — Merchant & Gould P.C.

(57) ABSTRACT

Grinding members on a grinding drum are arranged to move the material to be reduced laterally across the drum. The drum may be used in a tub grinder where the tub is configured to rotate about a vertical axis. In a tub grinder environment, the drum extends through the grinding floor, is configured to rotate about a horizontal axis, and includes cutters arranged in a right-handed helical pattern on the drum.

8 Claims, 10 Drawing Sheets

GRINDING DRUM WITH A CUTTER ARRANGEMENT FOR A DIRECTION OF ROTATION

CROSS REFERENCE TO RELATED APPLICATIONS

This application claims the benefit of U.S. Provisional Application No. 60/878,934 filed Jan. 5, 2007. Such provisional application is incorporated herein by reference.

TECHNICAL FIELD

The present disclosure relates generally to machines that grind, shred, and/or chip various types of material. More particularly, this disclosure relates to the spatial arrangement of cutters on a drum of a grinder device. More particularly, the disclosure relates to a helical pattern of cutters on a drum that is configured to move materials laterally across the drum as it rotates.

BACKGROUND

Machines, such as grinders and chippers, are used for shredding, grinding, and/or chipping a variety of materials. For the purposes of this disclosure, the representative environment in which the principles of the invention are described will be that of a common tub grinder as tub grinders are illustrative of chipping and grinding machines. References herein to tub grinders and the features thereof, however, are not intended to be limiting as the principles of the invention are generally applicable to machines configured to reduce larger materials into smaller materials.

Grinders and chippers typically include a grinding or chipping chamber that houses a chipping or grinding device. The grinding device of a typical tub grinder includes a hammermill or hog, an anvil, and a screen that function cooperatively to reduce larger materials into smaller materials. Tub grinders typically include a grinding chamber that has a tub shaped portion that surrounds a portion of the hammermill or hog. The tub shaped portion is configured to rotate about a vertical axis while hammermill or hog is configured to rotate about a horizontal axis. Examples of tub grinder are shown and described in U.S. Pat. No. 5,507,441 to De Boef et al.; U.S. Pat. No. 5,950,942 to Brand et al.; and U.S. Pat. No. 6,840,471 to Roozeboom et al, all of which are presently assigned to Vermeer Manufacturing Company.

Typically the hammermills or hogs of the tub grinder include a number of grinding members such as cutters that are mounted to a cylindrical drum. Wear of the grinding members can limit the efficiency and effectiveness of the entire grinding system. In particular, wear of the grinding members can result in loss of hammer integrity, out-of-balance drum conditions, and increases in maintenance and service costs.

Advancements in the grinding and chipping arts have resulted in improved drum and grinding members. For example, U.S. Pat. No. 6,840,471 to Roozeboom et al. and U.S. Pat. No. 6,422,495 to De Boef et al. disclose a cylindrical grinding drum that includes grinding members that are more easy to replace than those of the prior art. Nonetheless, further improvements relating to the durability and effectiveness of grinding and chipping machines are desirable.

SUMMARY

The disclosure relates to a drum with grinding members arranged thereon in a manner that increase the lifespan of the grinding member. The disclosure also relates to method of grinding wherein the arrangement of the grinding members on a drum enables the drum to move the material to be reduced laterally across the drum. The disclosure further relate to a tub grinder with a drum and cutter arrangement that increase the effective life of the drum and cutters thereon.

According to one aspect of the present invention, there is provided a tub grinder comprising: a grinding floor; a tub positioned above the grinding floor, the tub being configured to rotate about a vertical axis; and a grinding device extending through the grinding floor, wherein the grinding device is cylindrical and configured to rotate about a horizontal axis and the grinding device includes cutters thereon arranged in a right-handed helical pattern on the grinding device.

According to another aspect of the invention, there is provided a grinding device, comprising: a cylindrical body portion including a first end and a second end, wherein the first end is arranged and configured to cooperate with a drive shaft; and a plurality of cutters arranged on the body portion such that the plurality of cutters cooperate to reduce materials when the drive shaft rotates in the clockwise direction, wherein the cutters are arranged in a right-handed helical pattern on the body portion.

According to a further aspect of the invention, there is provided a method of grinding material, comprising: arranging cutters on a cylindrical grinder, the cylindrical grinder having an axis of rotation and a longitudinal length, to cause the material to be ground such that the material moves along the length of the grinder when the grinder rotates about the axis of rotation.

According to yet another aspect of the invention, there is provided a method of rotating a cutter drum in a tub grinder, comprising: positioning the cutter drum with a first end towards a center of the tub and a second end towards an edge of the tub; and rotating the cutter drum to bias material towards the center of the tub.

While the invention will be described with respect to preferred embodiment configurations and a tub grinder environment, it will be understood that the invention is not to be construed as limited in any manner by either such configurations and environment. Instead, the principles of this invention extend to any grinding, shredding, and/or cutting environment in which the principles of the present invention may be employed. These and other variations of the invention will become apparent to those skilled in the art upon a more detailed description of the invention.

The advantages and features which characterize the invention are pointed out with particularity in the claims annexed hereto and forming a part hereof. For a better understanding of the invention, however, reference should be had to the drawings which form a part hereof and to the accompanying descriptive matter, in which there is illustrated and described a preferred embodiment of the invention.

DETAILED DESCRIPTION

Reference will now be made in detail to various features of the present disclosure that are illustrated in the accompanying drawings. Wherever possible, the same reference numbers will be used throughout the drawings to refer to the same or like parts.

Figure 1:
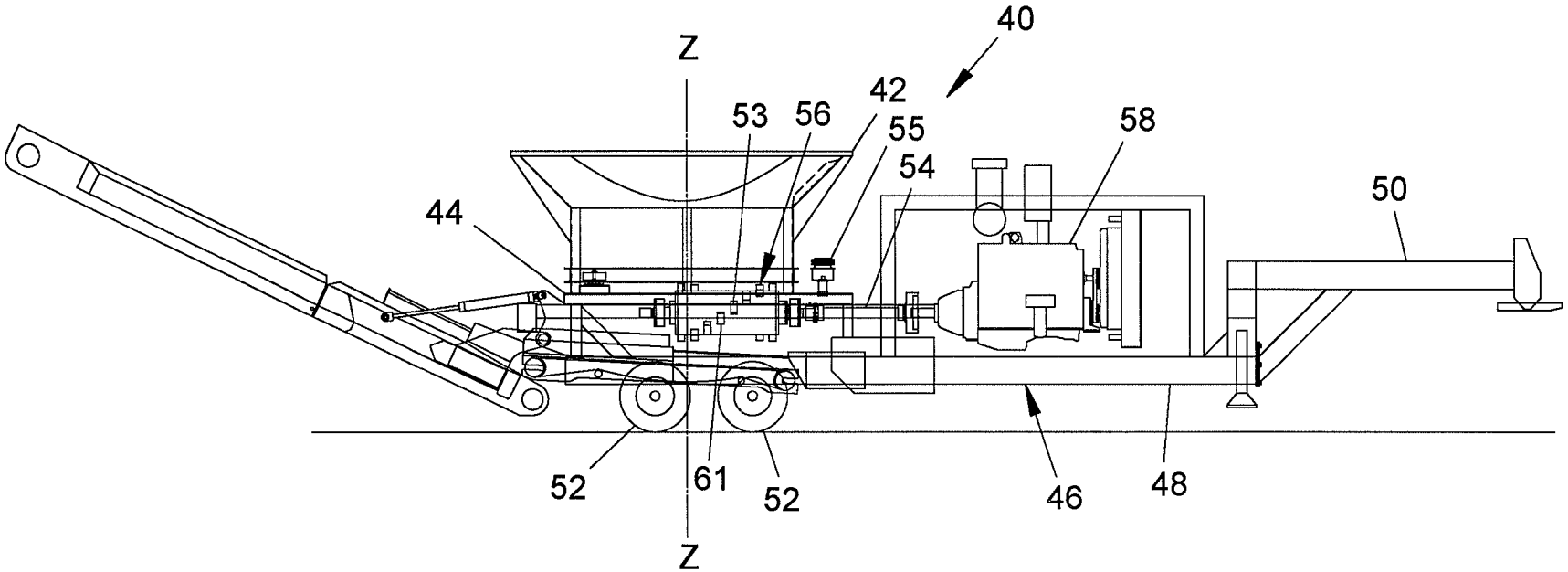
FIG. 1 Prior Art
FIG. 1 is a schematic illustration of a prior art tub grinder.
Figure 2:
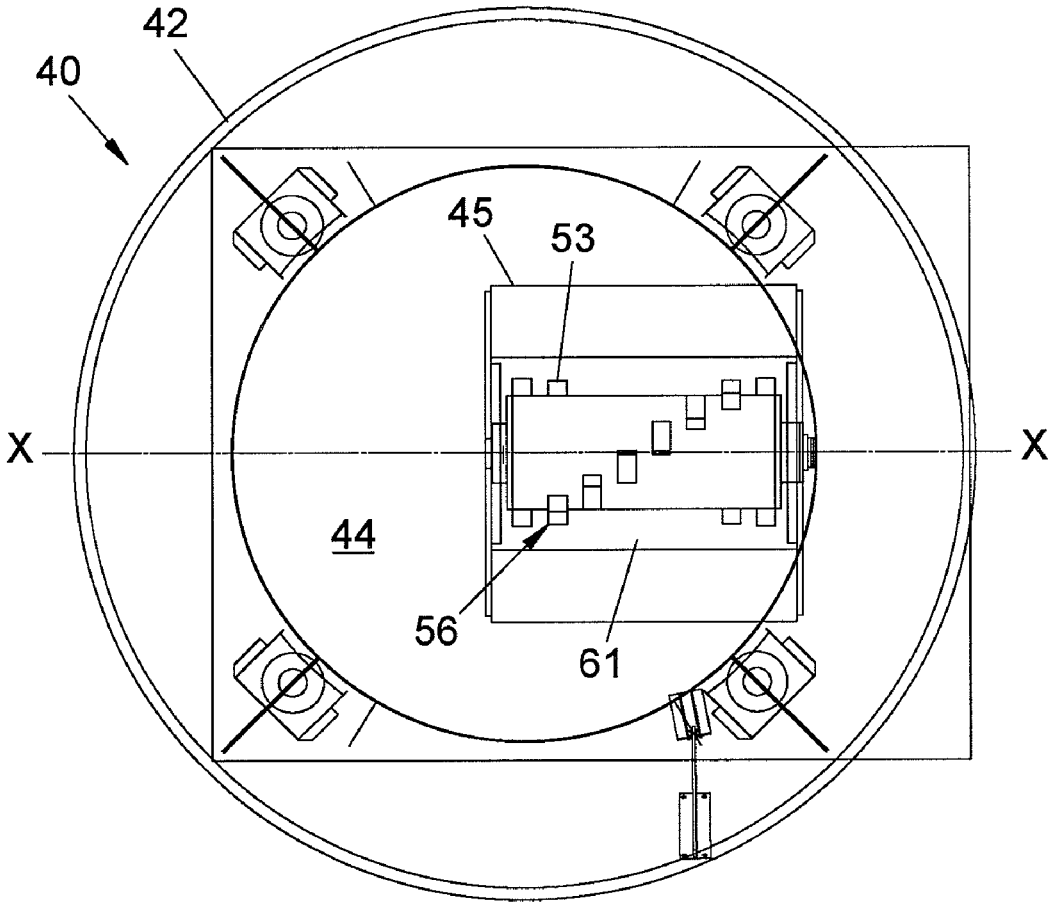
FIG. 2 Prior Art
FIG. 2 is a top view of the prior art tub grinder of FIG. 1.

Referring to FIGS. 1 and 2, a prior art tub grinder 40 is shown. The prior art tub grinder 40 is being shown to provide an illustrative field or environment to which the various aspects of the present invention are applicable. As discussed above, it should be appreciated that tub grinders are but one example of a type of grinding/chipping machine in which the various aspects of the present invention can be applied.

The prior art tub grinder of FIGS. 1 and 2 includes a rotary tub 42 mounted above a horizontal stationary floor 44. The rotary tub 42 is configured to rotate about a vertical axis z-z. The floor 44 and the tub 42 are secured to a frame 48 of a trailer 46. The depicted frame 48 includes a hitch 50 for attachment to a semi-tractor for towing the tub grinder 40. Wheels 52 are mounted on the frame 48. A prior art hammermill 56 is secured to the frame 48 beneath the tub 42.

As best illustrated in FIG. 2, the floor 44 includes a floor opening 45 for allowing an upper portion of the prior art hammermill 56 to extend into the tub 42 (in the remainder of this disclosure the term "hammermill" is meant to be synonymous with hog, rotary grinder, or grinding device). The prior art hammermill 56 is mounted for rotation about a horizontal axis x-x and includes a plurality of hammers 53 (shown schematically in FIGS. 1 and 2 and in more detail in FIG. 3) configured to engage matter deposited in the tub 42.

Still referring to FIGS. 1 and 2, the prior art hammermill 56 is coupled via a drive shaft 54 to an engine 58 for rotating the prior art hammermill 56. In operation, the tub 42 is rotated about the vertical axis z-z by a motor 55 (shown in FIG. 1). Simultaneously, the hammermill 56 is rotated about the horizontal axis x-x.

Figure 3:
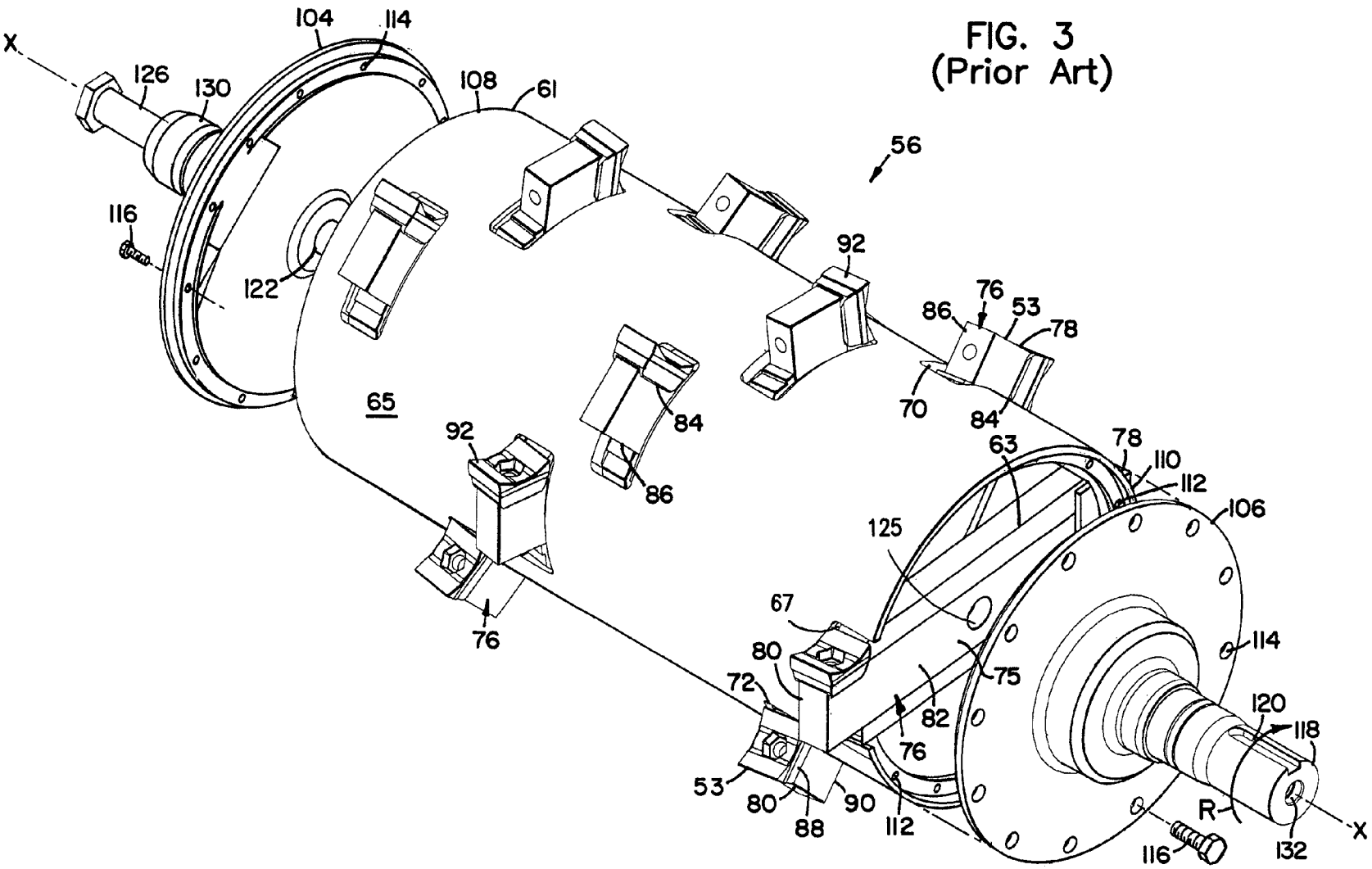
FIG. 3 (Prior Art)
FIG. 3 is a partially exploded perspective view of a prior art grinding member.

Referring to FIG. 3, the prior art hammermill 56 is shown in isolation from the tub grinder 40. The drum 61 of the hammermill 56 includes oppositely positioned first and second ends 108 and 110 that are respectively closed or covered by first and second end caps 104 and 106. The first and second ends 108,110 have threaded holes 112 that align with corresponding holes 114 in the first and second end caps 104,106. The end caps 104, 106 are preferably removably connected to the drum 61. For example, bolts 116 can be used to removably secure the end caps 104, 106 to the drum 61 by inserting the bolts through the holes 114 and then threading the bolts 116 into the openings 112. The removability of the end caps 104, 106 is advantageous because the drum 61, which has a greater tendency to wear than the end caps, can be replaced without requiring the end caps 104, 106 to be replaced at the same time. This also allows the drum 61 to be reversed (rotated end-to-end relative to the end caps 104, 106) to increase the useful life of the drum 61. Reversing the drum does not change the direction of the helix (i.e., the helix remain left-handed). The direction of the helix will be addressed in greater detail below. In the depicted prior art embodiment, the end caps 104, 106 are connected to the drum 61 by fasteners 116.

Still referring to FIG. 3, a driven shaft 118 is provided on the second end cap 106, and a non-driven shaft 130 is provided on the first end cap 104. The shafts 118, 130 are preferably connected to their respective end caps 106, 104 by conventional techniques (e.g., the shafts 118, 130 can be welded to or forged as a single piece with their respective end caps 106, 104). The shafts 118, 130 are aligned along the axis of rotation x-x of the hammermill 56 and project axially outward from their respective end caps 106, 104. The driven shaft 118 defines a keyway 120 or other type of structure (e.g., splines) for use in coupling the driven shaft 118 to the drive shaft 54 of the engine 58. In this manner, engine torque for rotating the hammermill 56 can be transferred to the hammermill 56 through the driven shaft 118. When mounted within the tub grinder 40, the shafts 118, 130 are preferably supported in conventional bearings (not shown) adapted for allowing the hammermill 56 freely rotate about the axis of rotation x-x.

The prior art hammermill 56 also includes a plurality of through-members 76 (e.g., bars) that extend radially through the drum 61 and include ends that project radially beyond the exterior surface 65 of the drum 61. Each of the through-members 76 forms two hammers 53 positioned on opposite sides of the drum 61. Hence, the through-members 76 can be referred to as "duplex hammers." The particular prior art embodiment shown includes eight through-members 76 that provide a total of sixteen hammers.

The through-members 76 each have a first end 78, a second end 80 and a central portion 82. The central portions 82 are situated in the interior of the cylindrical drum 61. Each through-member 76 extends through one of the holes 70 of the drum 61, and also through the corresponding opposite hole 72 of the drum 61. Within the drum 61, the through-members 76 extend through the channels 75 defined by the sleeves 63. The holes 70, 72 allow the first and second ends 78, 80 to be situated outside the exterior of the cylindrical drum 61 so as to form exterior hammers. Each through-member 76 has a leading face 84 and a trailing face 86 on the first end 78, and a leading face 88 and trailing face 90 on the second end 80. The leading faces 84 and 88 and the trailing faces 86 and 90 extend radially outward beyond the exterior surface 65 of the drum 61. The leading faces 84 and 88 are the surfaces that lead the through-member 76 as it rotates in a clockwise direction designated as R in FIG. 3 (view from the drive shaft 54 towards the driven shaft 118).

A cutter 92 is attached to each of the leading faces 84 and 88 of the through-members 76. FIG. 3 shows one of the cutters 92 adapted to be attached to one of the leading faces 84. In the prior art embodiment, the cutter 92 is symmetrical, including 2 cutting edges. The effective cutting edge is located on the outside, at the extreme radial dimension of the assembly, defining the cutting diameter. In that position there is a second cutting edge on the opposite end of the cutter that is located below the outside surface 65 of the drum 61. In this manner the second cutting surface is protected by the outside surface 65.

When the cutter 92 is clamped to the through-member 76 as shown in FIG. 3, the cutter 92 opposes or engages a retaining shoulder 67 formed at the end of the sleeve 63. Similar cutters 92 and retaining shoulders 67 are located at each end of each through-member 78. Engagement between the cutters 92 and the shoulders 67 functions to center or align the through-members 78 such that central openings 125 of the through-members 78 align with the axis of rotation x-x of the hammermill 56. The sleeves 63 also function to guide the through-members 76 through the openings 70, 72.

The prior art hammermill 56 also can include a rod 126 that extends along the axis of rotation x-x as shown in FIG. 3. The rod 126 extends through a longitudinal opening 122 defined by the non-driven shaft 130 and the first end cap 104. The rod 126 also extends through the plurality of co-axially aligned, central openings 125 defined by the through-members 76. The rod 126 also can include a threaded end that threads within an internally threaded opening 132 defined by the driven shaft 118. In this manner, the rod 126 could be used to clamp the end caps 104, 106 together. The rod 126 functions as a hammer retention system for the through-members 76 within the drum 61. A significant aspect of the invention is that a single retaining member (i.e., the rod 126) can be used to secure all of the through-members 76 to the drum 61.

Figure 4:
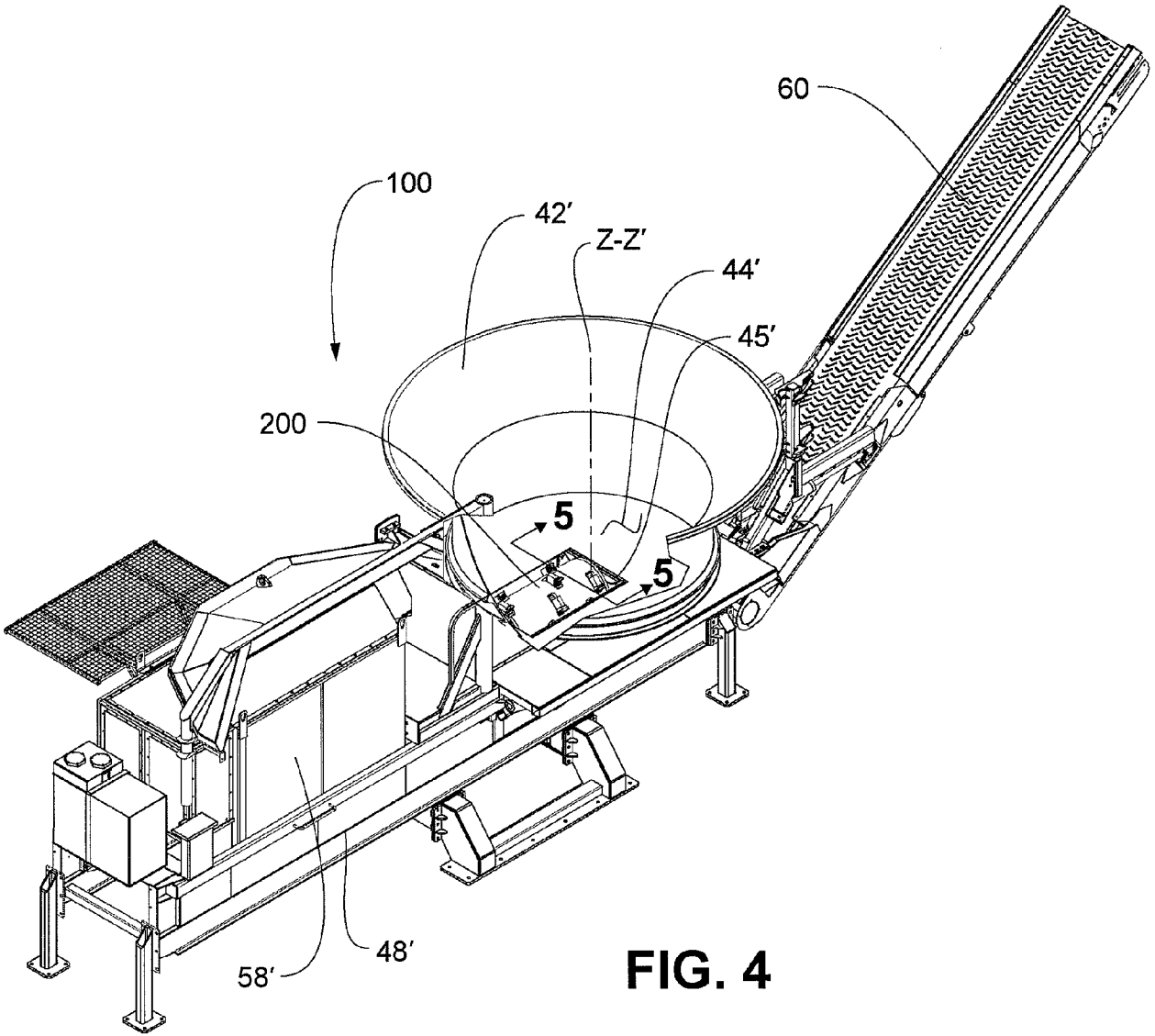
FIG. 4 is perspective view of one embodiment of a of the invention with portions of the tub removed for clarity.

Referring to FIG. 4, a perspective view of an embodiment of the present invention is shown. FIG. 4 illustrates the typical configuration of a tub grinder 100 that includes a prime mover 58' that could be an electric motor, gas motor or a diesel engine mounted to a frame 48'. The analogous prime mover in the prior art grinder shown in FIGS. 1-2 is referenced as engine 58. Frame 48' can be mounted to rigid ground supports, as illustrated, so that the tub grinder 100 is essentially stationary. Alternatively, the frame could be mounted to wheels 52 as illustrated in the prior art embodiment of FIGS. 1-2.

Figure 5:
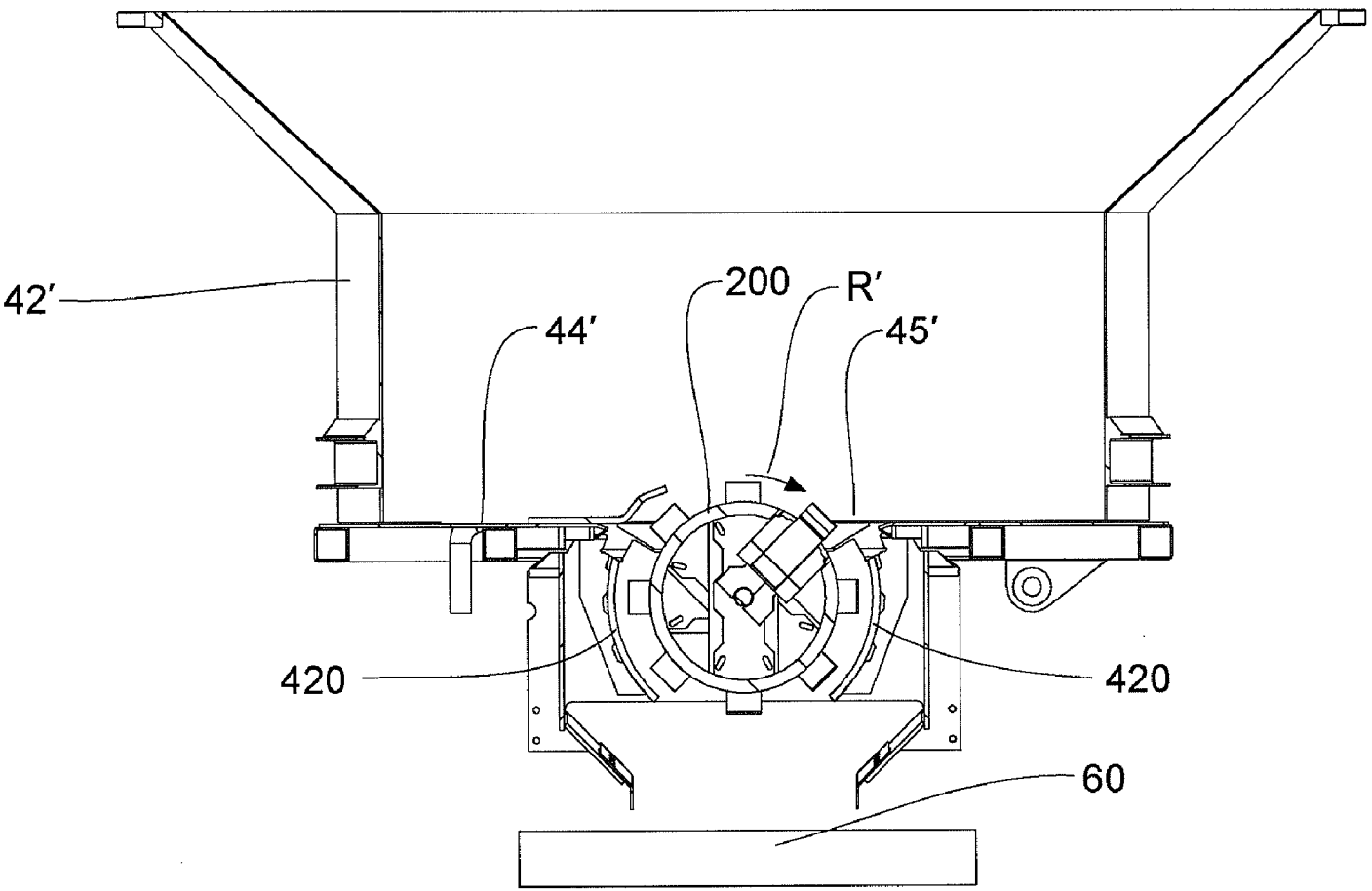
FIG. 5 is a cross sectional view of FIG. 4 along lines 5-5.

A tub 42' is mounted rotationally to the frame so that it can be rotated over a stationary grinding floor 44' in either direction about a tub axis of rotation z-z'. A grinding drum 200 is mounted in an aperture 45' in the grinding floor 44', a portion of the tub 42' has been cut-away in FIG. 4 to make the drum and aperture more visible, and is also illustrated in FIG. 5. As the tub 42' rotates with the floor 44' stationary, material is moved across the drum 200. The drum pulls material down through the aperture 45', while simultaneously dragging or forcing it through screens 420 so that the material will then fall onto a conveyor 60.

Figure 6:
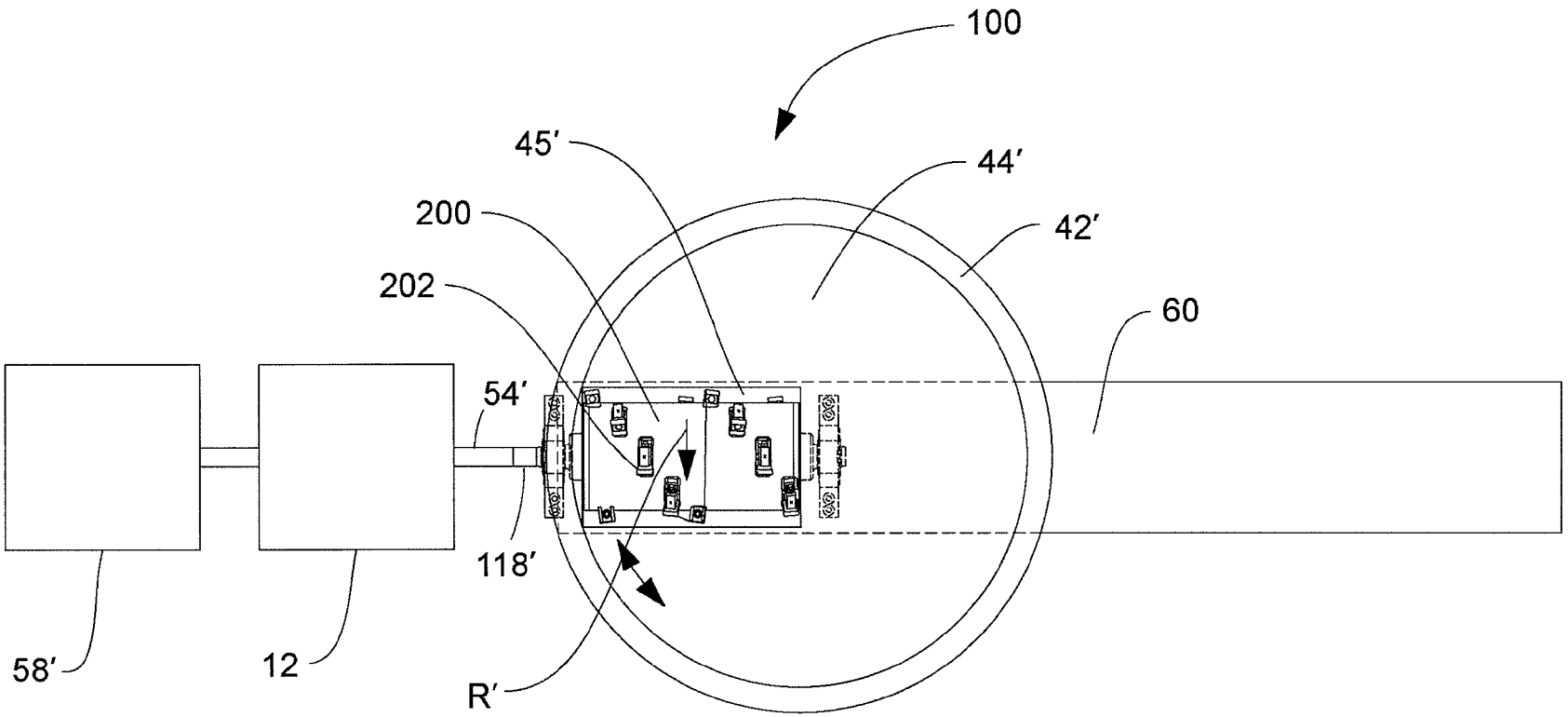
FIG. 6 is a top schematic view of the embodiment of FIG. 4.

FIG. 6 is a schematic drawing of a tub grinder 100 with a prime mover 58' and a driveline 12 connected to a drum 200. The present invention relates to a specific clockwise direction of rotation labeled as R' (viewed from the drive shaft 54' towards the driven shaft 118'), of the drum 200. As the tub 42' rotates, the material within the tub (not shown) that is closest to the walls of tub 42' move more than material that is close to the center of the tub 42'. At the axis of rotation z-z' (best seen in FIG. 4) there will be essentially no movement of the material. Thus, the portion of the drum 200 closest to the tub 42' will experience more material movement than portions near the center of the tub 42'. Accordingly, the cutting members (e.g., cutters 202) located closer to the outside of the tub 42' will tend to wear faster than the cutting members closer to the center of the tub 42'. For maximum productivity and cutter/drum durability, the material movement across the drum 200 would be as consistent and/or uniform as possible so that the cutters 202 at both ends of the drum 200 wear evenly. The drum 200 of the present disclosure is configured to move material towards the center of the tub 42', to help balance the material flow across the drum 200 thereby maximizing the useful life of the cutters 202 on the drum 200.

Figure 7:
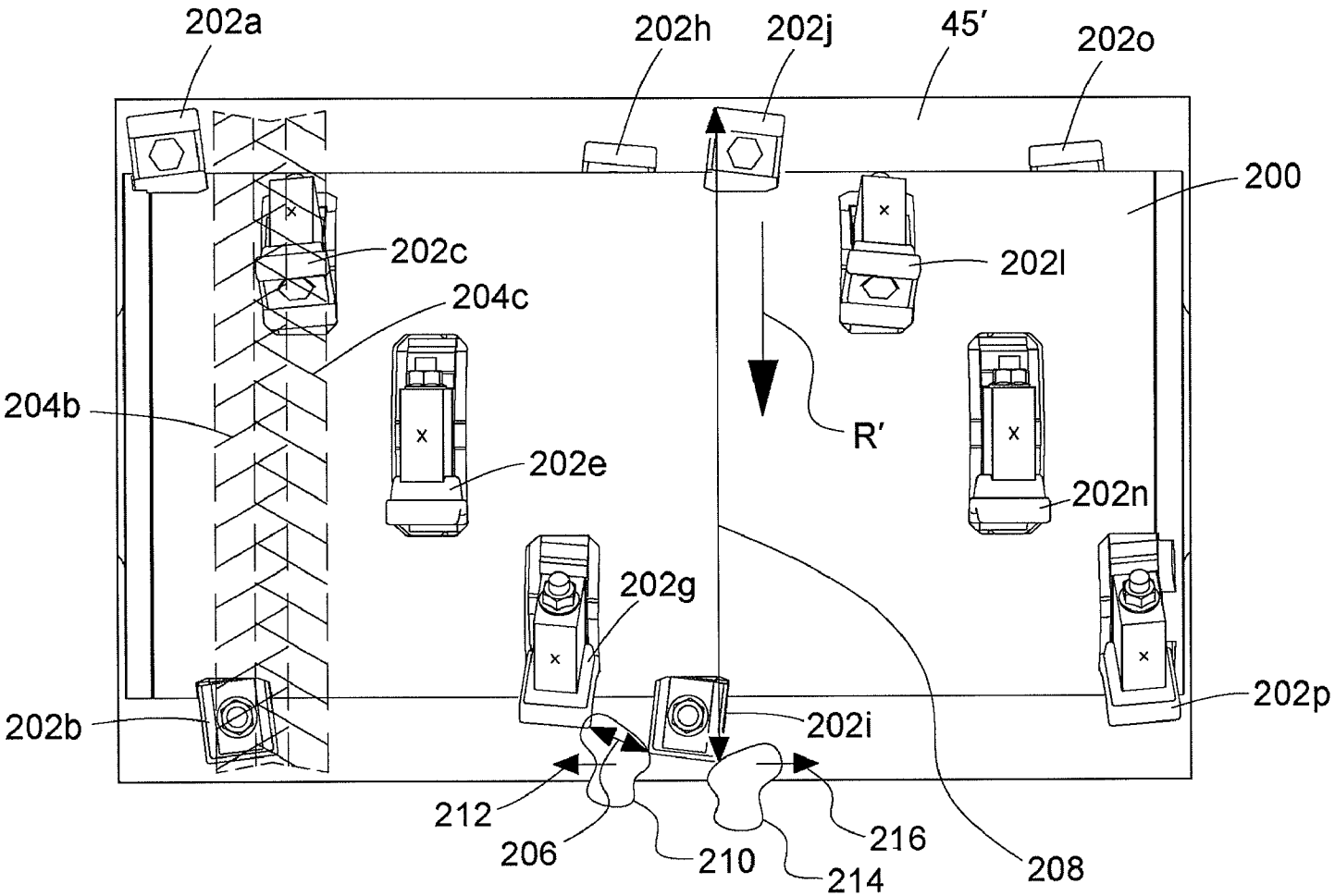
FIG. 7 is a side view of a portion of the embodiment of FIG. 4.
Figure 8:
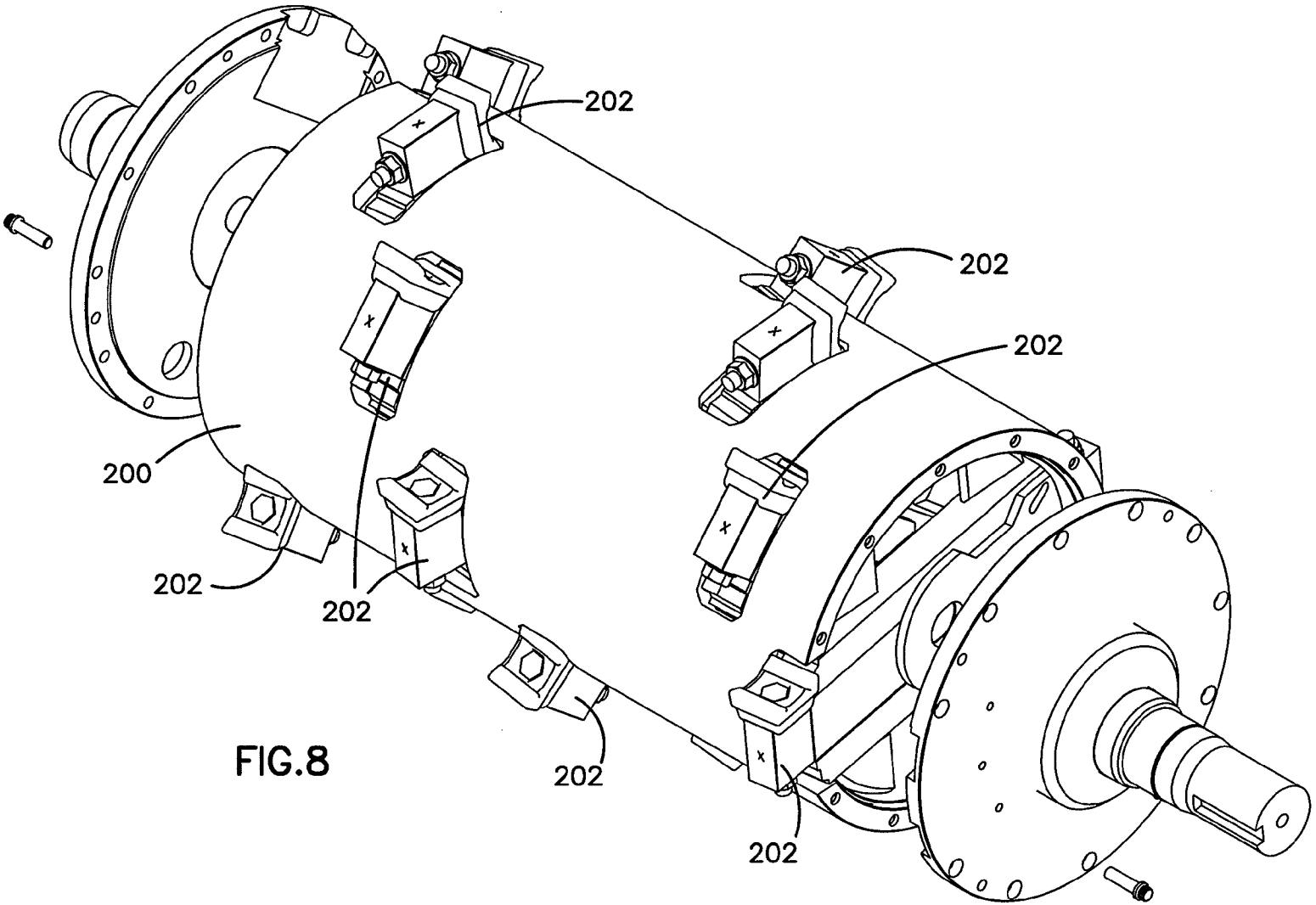
FIG. 8 is a partially exploded perspective view the grinding member of FIG. 7.

Referring to FIGS. 7 and 8, an arrangement of the cutters 202*a-p* on the drum 200 is shown in more detail (noting that cutters 202*d*, 202*f*, 202*k*, and 202*m* are not specifically shown in FIG. 7 due to their location on the drum 200). As the drum 200 rotates, each cutter 202 defines a cylindrical path. For example, during each rotation of the drum 200 cutter 202*c* moves through path 204*c* and cutter 202*b* moves through path 204*b* (best seen in FIG. 7). In the depicted embodiment, the cutters 202 are arranged so that the paths of rotation overlap, and so that there is complete coverage.

Still referring to FIGS. 7 and 8, the cutters 202 are arranged in a helical pattern on the drum 200 similar to that of the prior art drum 56. However, the helical pattern of the drum 200 is the opposite direction as the helical pattern in the prior art drum 56. Helices can be either right-handed or left-handed. If the curve of the vertically positioned helix moves from the lower left to the upper right, then the helix is a right-handed helix. However, if it moves from the lower right to the upper left, it is a left-handed helix. Described differently, a right-handed helix spirals counterclockwise from the lower end to the upper end when view from the top and a left-handed helix spirals clockwise from the lower end to the upper end when view from the top. Handedness is a property of the helix, not of the perspective. As discussed above, a right-handed helix cannot be turned or flipped to look like a left-handed one (unless it is viewed through a mirror), and vice versa. In the depicted embodiment, the cutters 202 of drum 200 are arranged in a right-handed helical pattern, whereas the cutters 92 of the prior art hammermill 56 are arranged in a left-handed helical pattern. FIG. 8 includes the dimensions of a preferred embodiment of the grinding device.

Figure 9:
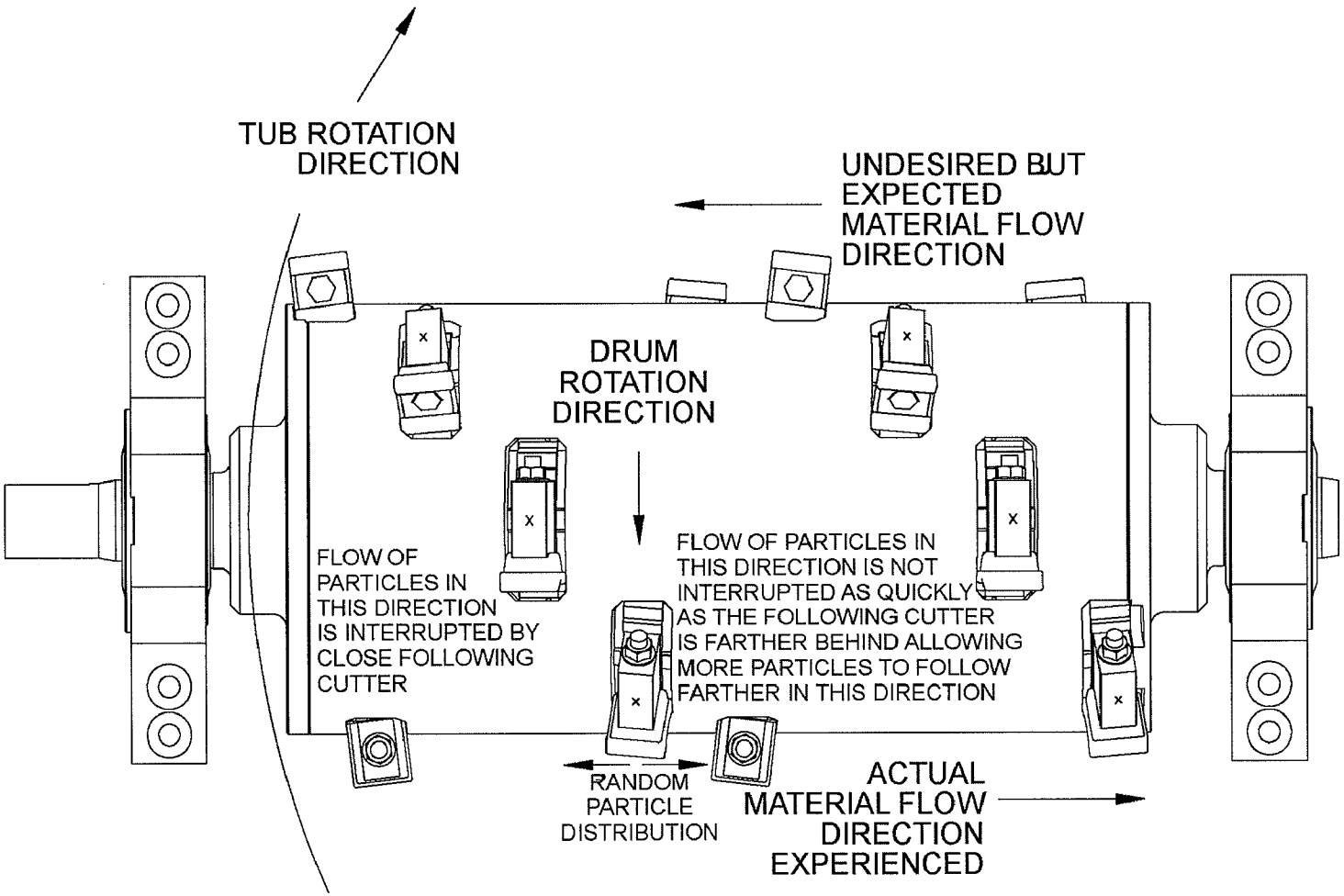
FIG. 9 illustrates the relationship between the helix direction, drum rotation direction, and material flow.
Figure 10B:
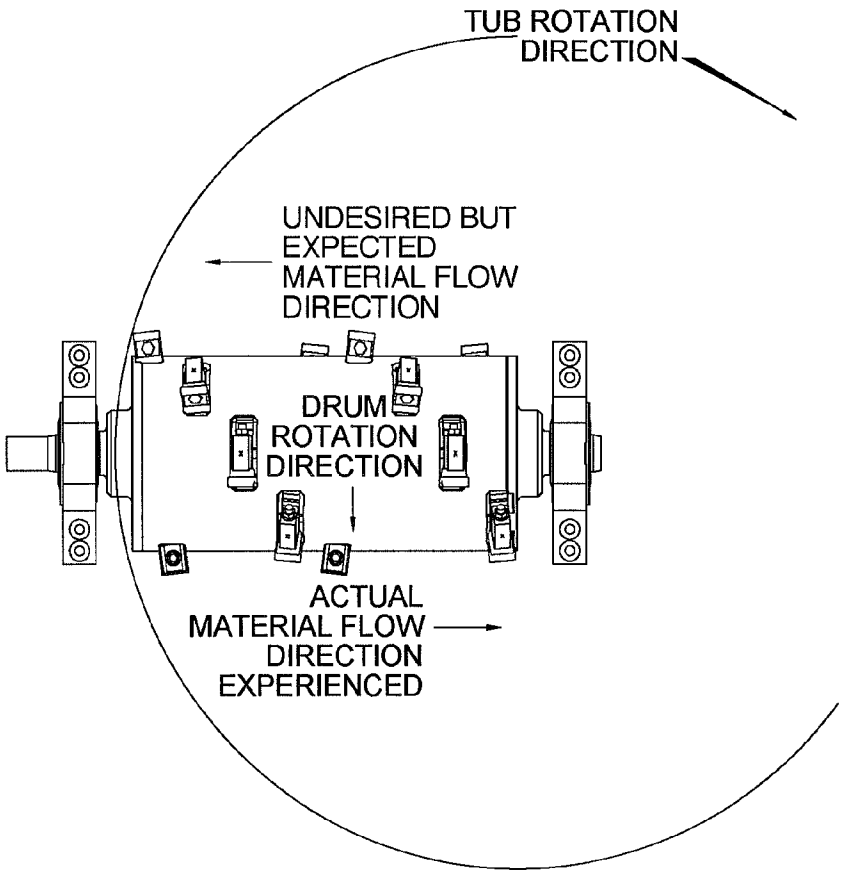
FIGS. 10A and 10B illustrate the effect of changing the helix direction on material flow direction while maintaining constant the drum rotation direction, and tub rotation direction.
Figure 10A:
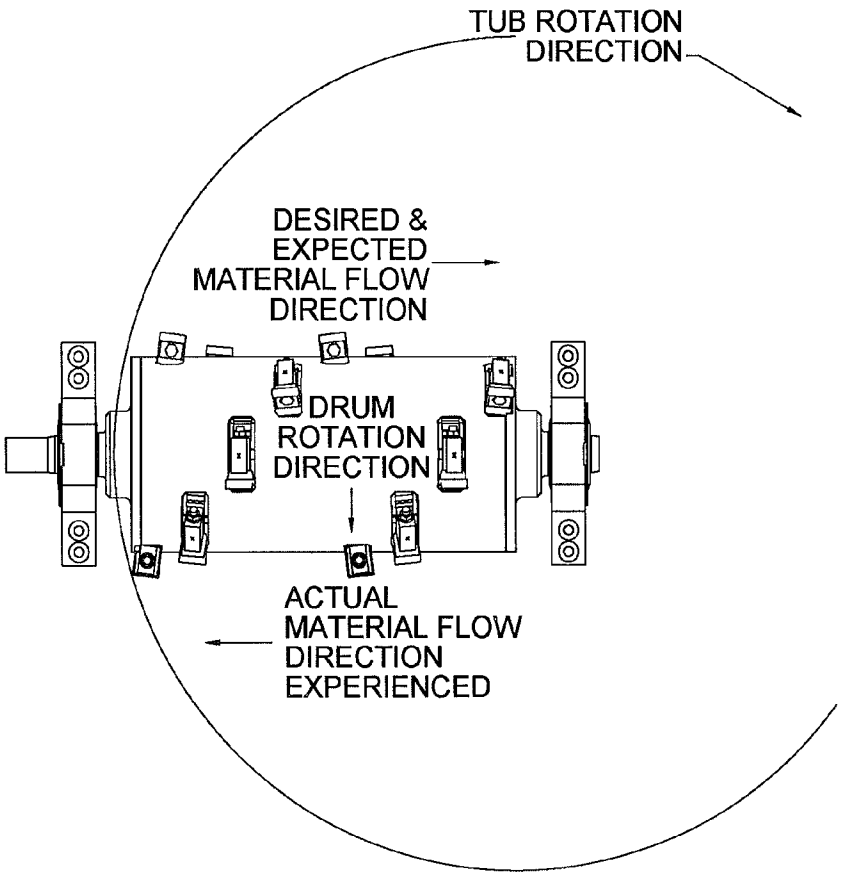

If the cutters 202 on the drum 200 were connected by structure, like an auger, then material would move from right to left as the drum was rotated in the direction R'. However, it has been found through experimentation that the opposite is true for the drum 200. In the depicted embodiment, material actually tends to move in the opposite direction (i.e., moving from left to right when the drum rotates in the R' direction). FIG. 9 illustrates the relationship between the helix direction, drum rotation direction, and material flow. FIGS. 10A and 10B further illustrate the effect of changing the helix direction on material flow direction while maintaining constant the drum rotation direction and the tub rotation direction.

The exact reason for this relationship is not presently known. The inventor believes, however, that this phenomenon is at least in part related to a difference in the distance from the closest trailing cutter on two sides of each cutter. This difference is illustrated in FIGS. 7 and 8, and can be seen by comparing the distance 206 to the distance 208. This difference can be appreciated by comparing the expected movement of a first particle 210 that is impacted by cutter 202*i*, which will move in direction 212 for a distance allowed by the time before it contacts the first trailing cutter 202*g*. The distance 206 is very short, thus it is expected that particle 210 will move a short distance from the right to the left. Comparing this to a particle 214 that is also contacted by cutter 202*i*, it will move in a direction 216, that will be interrupted when cutter 202*j* contacts the particle. The distance 208 is much larger than the distance 206, and thus it is expected that particle 214 would move significantly farther (to the right) or (laterally) than particle 210. The net effect is the drum rotated in direction R', with cutters arranged as shown, will tend to move (more) material from left to right (than right to left). The above-described combination of rotation and the arrangement of cutters has been experimentally shown to move material towards the center of the tub. This lateral movement of material across the drum 200 helps balance the material flow across the surface of drum 200 and evens the wear on the cutters 202. The benefit of such an arrangement includes increased productivity of the machine and longevity of the drum/cutters.

While particular embodiments of the invention have been described with respect to its application, it will be understood by those skilled in the art that the invention is not limited by such application or embodiment or the particular components disclosed and described herein. It will be appreciated by those skilled in the art that other components that embody the principles of this invention and other applications therefore other than as described herein can be configured within the spirit and intent of this invention. The arrangement described herein is provided as only one example of an embodiment that incorporates and practices the principles of this invention. Other modifications and alterations are well within the knowledge of those skilled in the art and are to be included within the broad scope of the appended claims.

What is claimed is:

1. A tub grinder comprising:

a grinding floor;

a tub positioned above the grinding floor, the tub being configured to rotate about a vertical axis; and a grinding device extending through the grinding floor, wherein the grinding device is cylindrical and configured to rotate about a horizontal axis and the grinding device includes cutters thereon arranged in a right-handed helical pattern on the grinding device, wherein materials placed in the tub are reduced when contacted with the grinding device and the reduced materials are induced to move laterally toward the center of the tub.

2. The tub grinder of claim 1, wherein the grinding device is a hammermill.

3. The tub grinder of claim 1, further comprising a tub grinder frame and wherein the grinding floor is stationary relative to the tub grinder frame.

4. The tub grinder of claim 1, wherein horizontal axis of rotation of the grinding device is located below the grinding floor.

5. The tub grinder of claim 1, wherein the grinding device is configured to engage a drive shaft that rotates in a clockwise drive direction when viewed from the drive shaft towards the grinding device.

6. The tub grinder of claim 5, wherein the cutters are configured such that the grinding device grinds more effectively when rotated in a clockwise direction then when rotated in a counterclockwise direction, wherein the clockwise and counterclockwise direction are from the perspective looking from the drive shaft towards the grinding device.

7. The tub grinder of claim 1, further comprising an engine wherein the output of the engine rotates in the same direction as the grinding device.

8. A method of rotating a cutter drum in a tub grinder, comprising:

positioning the cutter drum with a first end towards a center of the tub and a second end towards an edge of the tub, the cutter drum having a longitudinal axis extending from the first end to the second end;

locating cutter elements about a periphery of the cutter drum to reduce materials placed in the tub; and rotating the cutter drum about the longitudinal axis of the cutter drum to bias the reduced materials that remain in the tub towards the center of the tub.

* * * * *